US005566476A

United States Patent [19]

Bertrand et al.

[11] Patent Number: 5,566,476

[45] Date of Patent: Oct. 22, 1996

[54] ATHLETIC FOOT PROTECTOR WITH TOE AND ANKLE IMPACT ABSORBING PROTECTION

[76] Inventors: Gregory F. Bertrand, 7401 Whitewood Dr., Fontana, Calif. 92336; Thomas P. Seyler, 30515 Sand Trap Dr., Agoura Hills, Calif. 91301

[21] Appl. No.: 467,073

[22] Filed: Jun. 6, 1995

[51] Int. Cl.[6] ..... A43B 13/22; A43C 13/14

[52] U.S. Cl. ..... 36/72 R; 36/77 R

[58] Field of Search ..... 36/126, 133, 132, 36/136, 106, 72 R, 7.1 R, 7.2, 7.5, 107, 85, 87, 7.4, 7.3, 77 R

[56] References Cited

U.S. PATENT DOCUMENTS

| | | | |
|---|---|---|---|
| 1,987,782 | 1/1935 | Mason | 36/77 R |
| 2,392,867 | 1/1946 | Stoner et al. | 36/72 R |
| 3,040,455 | 6/1962 | Criswell | 36/72 R |
| 3,068,593 | 12/1962 | O'Donnell | 36/72 R |
| 3,806,145 | 4/1974 | Czeiszperger | 36/72 R X |
| 4,103,438 | 8/1978 | Fron | 36/77 R X |
| 4,497,070 | 2/1985 | Cho | 36/106 |
| 4,967,493 | 11/1990 | Mues | 36/72 R |
| 5,234,230 | 8/1993 | Crane et al. | 36/72 R X |
| 5,313,719 | 5/1994 | Koethe | 36/72 R |

FOREIGN PATENT DOCUMENTS

| | | | |
|---|---|---|---|
| 5220005 | 8/1993 | Japan | 36/107 |
| 2253128 | 9/1992 | United Kingdom | 36/132 |

*Primary Examiner*—B. Dayoan
*Attorney, Agent, or Firm*—Roger A. Marrs

[57] ABSTRACT

A protector as footwear for an athlete to be worn over the sports shoe covering the toe and sides of the foot and, when desired, an extension for protecting the instep, ankle and toes. The protector includes hinge connections between a thickened toe portion and a foot portion for releaseable attachment purposes. A liner is disposed on the inside of the protector. The hinge may be composed of an elastic, stretchable material or a mechanical hinge. The protector is composed of a durable, hard plastic composition to resist impact loads.

6 Claims, 2 Drawing Sheets

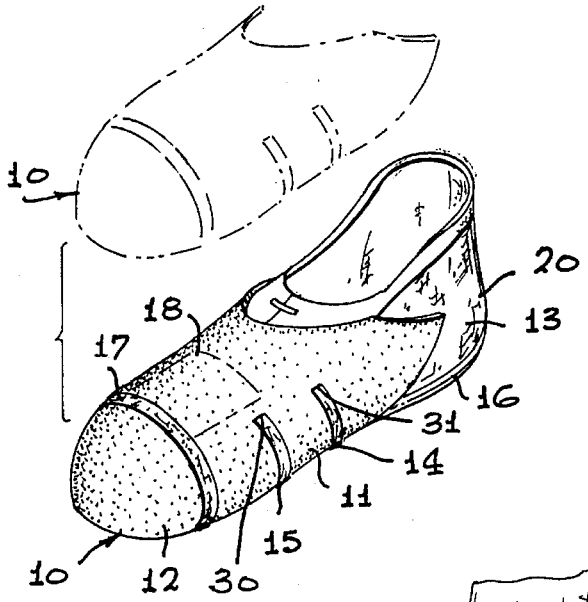
FIG. 1
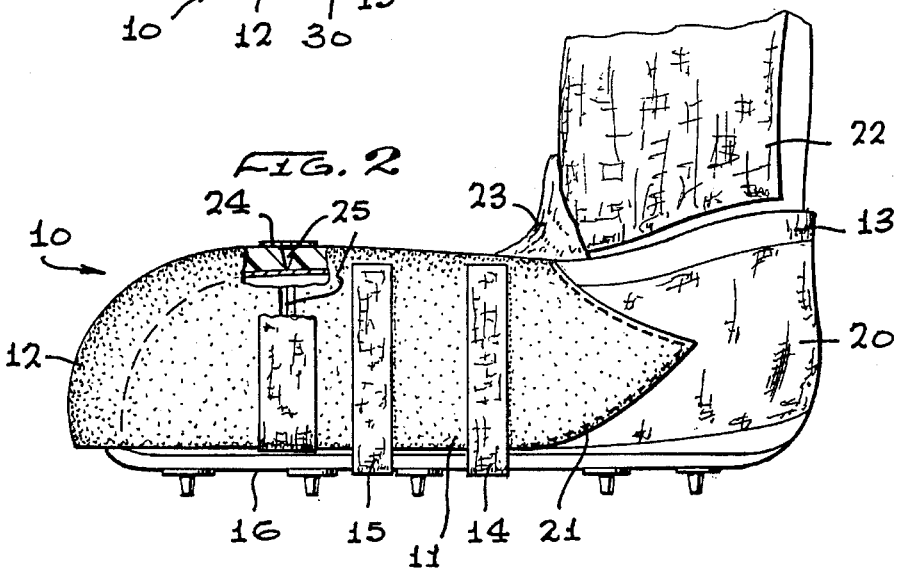
FIG. 2
FIG. 3
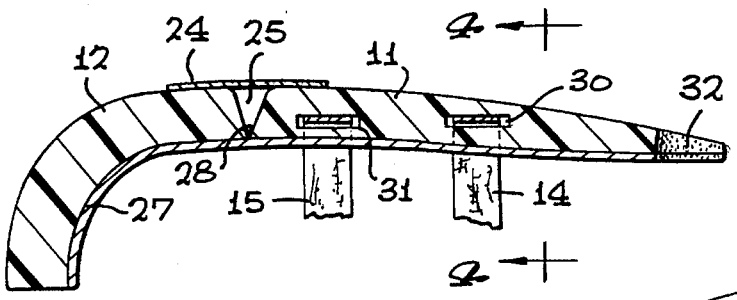
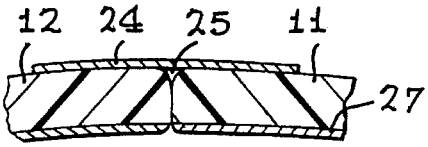
FIG. 5
FIG. 4
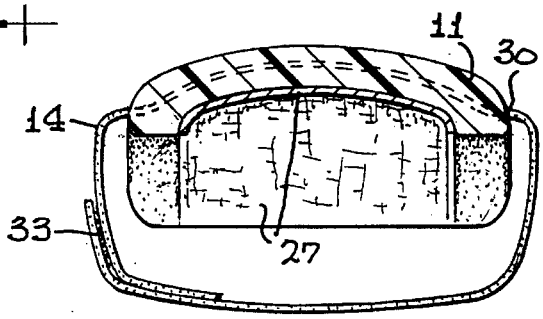

ATHLETIC FOOT PROTECTOR WITH TOE AND ANKLE IMPACT ABSORBING PROTECTION

BACKGROUND OF THE INVENTION

1. Field of the Invention

The present invention relates to the field of athletic equipment, and more particularly to novel footwear for protecting the toe area, instep and ankle area of a player engaged in the sport of baseball during a course of play.

2. Brief Description of the Prior Art

In the past, baseball players have encountered injury and physical damage due to inadvertent impact caused by baseballs which are forcibly hit or driven by a batter during a course of play. In this connection, the ball travels at high speed and with great force and impacts against the catcher's foot or even the batter's foot when the ball is hit. In general, a catcher as well as the hitter will wear some form of protective guards, such as hard helmets or caps, leg protectors, gloves or mitts or the like. However, problems and difficulties have been encountered with foot injuries due to a hit ball striking the toe area, foot instep and ankle areas. Such impacts cause injury when a ball hit by the hitter fouls and travels within the hitter's box in an uncontrollable manner. Since the catcher and hitter wear shoes which are composed of thin leather or are of fabric composition, no protection is provided for the foot and ankle areas.

Therefore, a long-standing need has existed to provide a protector for the foot of a baseball player which includes a removable protector adapted to covering the toe area, the instep area and the ankle area of either a catcher or a hitter or both. The protector should not inhibit the wearer from running, bending or walking about during the course of playing a game.

SUMMARY OF THE INVENTION

Accordingly, the above problems and difficulties are avoided by the present invention which provides a novel protector having a main instep covering which hingeably supports a toe portion and, if needed, an ankle protection or extension portion. The hinge for interconnecting the toe portion with the instep portion may be of a flexible material composition or it may be a mechanical connector or hinge and an inner liner is disposed under the toe portion and the instep portion so as to serve as an innerface between the protector and the shoe worn by the user. Attachment means for removably securing the protector to the wearer about his conventional shoe is provided and may be a strap or a pair of straps which extend from the protector underneath the sole of the wearer's shoe and which may have its opposite ends coupled by means of a hook and pile fastener or the like. The ankle protector includes an extension upwardly projecting from the instep portion on the inside of the user's leg and such an ankle protector may be used by the hitter as well as the toe protector as used by the catcher. A releaseable strap couples the ankle protector to the user's leg when the protector covering the toe and instep is employed.

Therefore, it is among the primary objects of the present invention to provide a novel protector for an athlete's foot that may be worn over the shoe that the athlete is wearing during the course of a game.

Another object of the present invention is to provide a novel protector for covering an athlete's foot which will protect the toe, instep and ankle of the user and which may be detachably secured about the conventional shoe worn by the player in any particular sport.

Another object of the present invention is to provide a novel protector which includes a hingeable toe portion interconnecting with an instep portion and wherein the protector is composed of a durable, hard plastic and that is shaped to formfit to meet the individual shoe size of the wearer.

Yet a further object of the invention resides in providing footwear protecting the foot of an athlete which is lightweight and does not restrict the player's mobility and which may be used in the game of baseball by either a hitter or a catcher.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 1 is a front perspective view showing the novel protector incorporating the present invention which may be used by a catcher in the game of baseball;

FIG. 2 is an enlarged side elevational view of the protector shown in FIG. 1;

FIG. 3 is a longitudinal cross-sectional view of the protector shown in FIG. 2;

FIG. 4 is a transverse cross-sectional view of the protector as taken in the direction of arrows 4—4 of FIG. 3;

FIG. 5 is a fragmentary sectional view of an alternate hinge connection employed in the protector of the present invention;

DESCRIPTION OF THE PREFERRED EMBODIMENT

Figure 6:
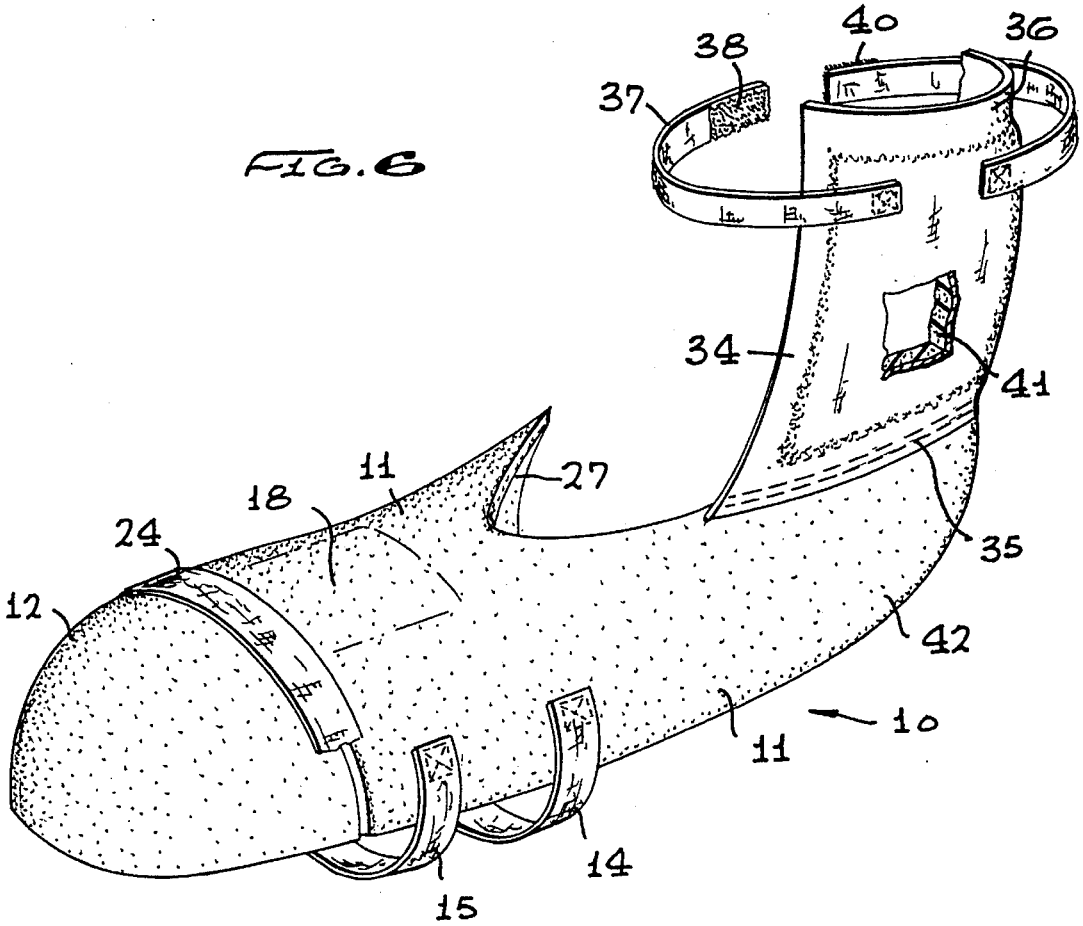
FIGS. 6 and 7 are perspective and top plan views respectively of the protector incorporating the present invention further illustrating an ankle protector such as may be used by hitters in the game of baseball.

Referring to FIG. 1, the novel athletic foot protector incorporating the present invention is illustrated in the general direction of arrow 10 which includes a central instep portion 11 and a toe portion 12 which formfits about the regular sport shoe, indicated by numeral 13. In broken lines, the protector is illustrated preparatory for placing on the exterior surface of shoe 13 and the protector is releasably held in position by means of straps 14 and 15. The straps extend from one side of the instep portion 11 to the opposite side of the instep portion about the sole 16 of the shoe 13.

The toe portion 12 is movably carried on one end of the instep portion 11 by means of a hinge that may take the form of a flexible fabric elastic composition, as indicated by numeral 17. However, other hinge means may be provided which will permit the toe portion 12 to move relative to the instep portion 11. Such a hinge means provides mobility for the user permitting the user to run, walk or move freely when it is necessary to flex the foot. Also, it is noted that the instep portion 11 may include a special space or area 18 on which advertising, graphic subject matter or other indicia may be placed. This may take the form of labels, printing, tags or other forms of display medium.

Referring now in detail to FIG. 2, it can be seen that the toe portion 12 and the instep portion 11 are composed of a moldable, durable and rigid plastic material whereas a heel portion 20 may be composed of a stretchable and elastic fabric which is attached to the instep portion 11 by means of double stitching, as indicated by numeral 21. The elastic heel portion 20 is band-like and stretches about the heel of the shoe 13 when the protector is installed on the shoe 13. The embodiment shown in FIG. 2 may be used to protect the toes of a catcher in the game of baseball and, as is the usual practice, a catcher wears a leg protector 22 across the front of his legs and the protector includes a pivot portion 23 which is flexibly carried on the bottom part of the leg protector 22. The leg protector and the portion 23 do not form a part of the present invention.

FIG. 2 also illustrates a flexible hinge 24 which covers a channel or groove 25 that interconnects the opposing surfaces of the instep portion 11 and toe portion 12. The gap therebetween permits relative movement giving the athlete mobility during the course of play. Furthermore, the underside of the protector includes a liner 27 which interfaces with the top of the athletic shoe worn by the wearer and protects the surface of the shoe from any scuffing or impact damage. It can be seen that the straps 14 and 15 pass under the sole 16 for releasable securement onto the outside of the shoe 13.

Referring now in detail to FIG. 3, it can be seen that the thickened toe portion 12, as well as the instep portion 11, are composed of a rigid plastic-like material and that the toe portion may be connected in alignment with the instep portion by the fabric hinge 24 which serves as a cover for the groove 25. The groove, opening or channel 25, permits relative movement since it is large at the top and narrows to the lining 27. A mechanical hinge 28 may be incorporated to further place the toe portion and instep portion in movable relationship. It is to be understood that the fabric hinge 24 is composed of a stretchable and elastic material which holds the two portions together but does not restrict their relative movement. Also, it can be seen that the straps 14 and 15 pass through slots 30 and 31 respectively which open at the opposite side of the instep portion adjacent its upper surface. The instep portion may terminate in a cushion material 32 which rests against the shoe or foot of the user and provides comfort during the course of play. However, it, is to be understood that the rest of the instep is of rigid and solid plastic material. The lining 27 may be suitably attached to the undersurface of the protector by any suitable means, such as adhesive or the like.

Referring now to FIG. 4, it can be seen that the opposite ends of each strap, such as strap 14, terminate in a hook and pile fastening means, indicated by numeral 33. In this manner, a releasable connection between the opposite ends of the strap is provided. Also, it can be seen that the strap proceeds across the full width of the instep portion 11 through the slot 30, as previously described. The lining 27 is disposed on the underside of both the protector and instep portions.

In FIG. 5, the fabric elastic hinge 24 is illustrated as covering the channel or space 25 adjacent to the opposing ends of the toe portion 12 and the instep portion 11. The lining 27 is discontinuous and does not join the undersurface of the two portions together as previously described with respect to the embodiment shown in FIG. 3. It is to be particularly noted that the terminating ends of the portions 11 and 12 are rounded so as to permit rolling or rotation of one portion with respect to the other during walking or running as in the course of a game. The hinge means 24 can be fixedly secured to the edge marginal regions of the opposing ends of the portions by any suitable means, such as adhesive attachment or by using fasteners of conventional design.

Figure 7:
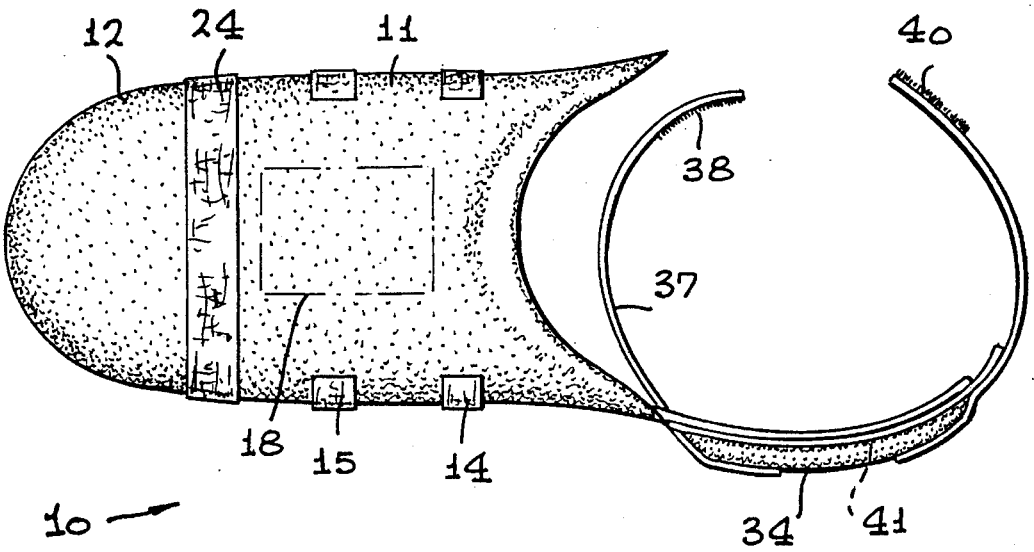

Referring now in detail to FIGS. 6 and 7, the toe and instep portions 11 and 12 respectively further include an ankle protector taking the form of an extension 34 which has one end attached to the instep portion 11 by means of double stitching 35 and which terminates at a free end 36 adjacent to the inside ankle of the user. A strap means 37 having hook and pile attachments 38 and 40 respectively secure the extension 34 about and above the ankle of the user. Also, it is to be noted that the inside surface of the ankle extension 34 is covered with a cushion material, such as foam or the like, and indicated by numeral 41. It is to be understood that the elastic fabric 20 may be used at the heel of the protector or, as illustrated, a solid, rigid extension or projection of the instep portion 11 may be used, as indicated by numeral 42, which supports the extension 34. In this manner, the straps 14 and 15 solely secure the protector onto the shoe 13 of the user.

In view of the foregoing, it can be seen that the protecting device of the present invention shields the user's toe and instep as well as the ankle from impact generated by a foul ball or a wild pitch the impact force is distributed throughout the protector and is not concentrated at any one location. The thickness of the protector is sufficient to absorb impact energy. Movement of the wearer is permitted since the toe portion 12 will permit relative movement between portion 12 and the instep portion 11. The straps 14, 15 and 37 are readily secured together without need for sizing since the hook and pile fasteners may permit adjustment.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. An athletic foot protector to be worn over the user's shoe comprising:

a rigid, reinforced central instep portion having a front end and a rear end adapted to cover the central portion of the user's foot;

a rigid, reinforced toe portion separate from said central instep portion;

a hinge pivotally connecting said toe portion with said central instep portion at the ball area of the user's foot;

securement means releasably attaching said central instep portion to the foot of the user;

an expandable and stretchable heel portion of soft, flexible and stretchable material carried on said central instep portion at said rear end and adapted stretch about the heel of the user's foot;

a flexible, soft liner carried on said toe portion and said central portion adjacent to the foot of the user;

said toe portion and said central instep portion are composed of a hard plastic material;

said toe portion is of greater thickness than the thickness of said central instep portion;

said securement means is at least one strap having opposite ends adapted to encircle the foot and said shoe of the user so that said opposite ends overlap in releasable securement;

an elongated extension carried on said central instep portion at said rear end and upwardly projecting to cover the medial ankle of the user; and a releasable strap disposed on said elongated extension for removably securing said elongated extension to the ankle of the user.

2. The protector as defined in claim 1 including:

a resilient pad carried on said central instep portion at said rear end;

3. The protector as defined in claim 2 wherein:

said central instep portion is U-shaped in transverse cross-section and has open-ended passageways conducting said securement means therethrough.

4. The protector as defined in claim 3 wherein:

said hinge is composed of elastic material allowing relative movement between said toe portion and said central instep portion.

5. The protector as defined in claim 4 wherein:

said securement means includes hook and pile connection between said opposite ends.

6. The protector as defined in claim 5 wherein:

said resilient pad composed of cushion material carried on said inside surface of said elongated extension.

* * * * *